US007530385B2

(12) United States Patent
Liu et al.

(10) Patent No.: US 7,530,385 B2
(45) Date of Patent: May 12, 2009

(54) ROTARY-TYPE TOTAL HEAT EXCHANGER

(75) Inventors: Tay-Jian Liu, Tu-Cheng (TW); Shun-Yuan Jan, Tu-Cheng (TW); Shang-Chih Liang, Tu-Cheng (TW); Chih-Feng Fan, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 423 days.

(21) Appl. No.: 11/211,968

(22) Filed: Oct. 20, 2005

(65) Prior Publication Data

US 2006/0175038 A1 Aug. 10, 2006

(30) Foreign Application Priority Data

Feb. 4, 2005 (TW) ..... 94103786 A

(51) Int. Cl.
*F23L 15/02* (2006.01)
*F24H 3/02* (2006.01)

(52) U.S. Cl. ..... 165/8; 165/54; 165/903

(58) Field of Classification Search ..... 165/8, 165/903, 54

See application file for complete search history.

(56) References Cited

U.S. PATENT DOCUMENTS 4,331,198 A * 5/1982 Michalska et al. ..... 165/9
4,563,126 A * 1/1986 Kobayashi et al. ..... 415/119
4,579,163 A * 4/1986 Maendel ..... 165/54
4,595,403 A 6/1986 Sago et al.
4,650,621 A 3/1987 Sago et al.
4,712,611 A * 12/1987 Witzel ..... 165/122
5,183,098 A 2/1993 Chagnot
5,238,052 A 8/1993 Chagnot
5,426,953 A * 6/1995 Meckler ..... 62/271
6,209,622 B1 4/2001 Lagace et al.
6,575,228 B1 * 6/2003 Ragland et al. ..... 165/54
7,104,082 B1 * 9/2006 Moratalla ..... 62/271
7,445,038 B2 * 11/2008 Liu et al. ..... 165/8
2006/0137852 A1 * 6/2006 Liu et al. ..... 165/8
2006/0213636 A1 * 9/2006 Liu et al. ..... 165/8

FOREIGN PATENT DOCUMENTS

CN 2429774 Y 5/2001

* cited by examiner

*Primary Examiner*—Cheryl J Tyler
*Assistant Examiner*—Brandon M Rosati
(74) *Attorney, Agent, or Firm*—Frank R. Niranjan

(57) ABSTRACT

A rotary-type total heat exchanger (10) includes two blowers (21, 22), a rotary wheel (33), an air-guiding member (41) and an air-regulating member (42). The blowers are used to provide a first airflow and a second airflow into the total heat exchanger. The rotary wheel defines therein a plurality of air passageways (331). Upon rotation, the rotary wheel is capable of exchanging heat and moisture between the airflows when the airflows separately flow though the air passageways of the rotary wheel. The air-guiding member is in fluid communication with one of the blowers for guiding one of the airflows toward the rotary wheel. The air-regulating member is located between the rotary wheel and the air-guiding member for distributing the guided airflow over the air passageways of the rotary wheel.

20 Claims, 9 Drawing Sheets

ROTARY-TYPE TOTAL HEAT EXCHANGER

TECHNICAL FIELD

The present invention relates generally to a total heat exchanger, and more particularly to a rotary-type total heat exchanger which may suitably be applied to a ventilation system for exchanging heat and moisture between a first air stream and a second air stream.

BACKGROUND

In our daily life, ventilation systems such as air-conditioners are commonly used in working or living spaces, e.g., office buildings and apartments, for supplying fresh outdoor air and exhausting polluted indoor air simultaneously in order for keeping a favorable and healthy environment to stay. Generally, the supplied air and the exhausted air have different temperatures and humidities. In this connection, a significant effect of energy saving could be expected if the exchange between the indoor air and the outdoor air can be achieved not only in heat but also in moisture. In order to satisfy such requirements, total heat exchangers are developed. A total heat exchanger is capable of exchanging sensible heat (temperature) and latent heat (moisture) simultaneously between different types of airflows without mixing them, and therefore is an effective means for saving energy by recovering both sensible energy (temperature) and latent energy (moisture) between the airflows.

A total heat exchanger generally employs a heat exchanging element as a tool, through which both the supplied air and the exhausted air pass and by which the exchange of heat and moisture between the airflows is carried out. If the exchanging element employed is a rotary heat exchange wheel, then the total heat exchanger using the rotary wheel is typically referred to as "rotary-type total heat exchanger". Generally, a rotary wheel is constructed in the form of mesh-like or honeycomb structure which is comprised of a matrix or media of heat exchange material (capable of absorbing thermal energy) coated or impregnated with a hydrophilic material (capable of absorbing moisture), wherein the heat exchange material may be, among others, metal wire, ceramic fiber, asbestos paper or fiberglass. Thus, the rotary wheel is capable of absorbing moisture and/or thermal energy from one stream and upon further rotation of the wheel, releasing the moisture and/or thermal energy to an adjacent stream. For example, in winter, the wheel can be used to recover heat and moisture from relatively higher temperature exhausted air from indoors for transfer to a cool, dry supplied air from outdoors. In a summer season, the wheel can also be applied to cool and dehumidify a hot, moist supplied air from outdoors by extracting moisture and heat energy and then transferring to a relatively cooler and drier exhausted air from indoors.

An example of a rotary wheel in a rotary-type total heat exchanger is shown in FIG. 12. The rotary wheel 1 is in a cylindrical form and has a beehive-like structure with a plurality of air passageways 2 defined parallel to the axis of the wheel 1. The wheel 1 is mounted to a frame comprised of a vertical plate 3 and a horizontal plate 4, and is maintained across a first air stream (e.g., supplied fresh outdoor air indicated by arrows E-E) and an adjacent but separate second air stream (e.g., exhausted dirty indoor air indicated by arrows F-F). The horizontal plate 4 traverses the vertical plate 3 to thereby divide the wheel 1 into two semi-circular portions. The supplied air and the exhausted air flow respectively through the two portions of the wheel 1 in a counter-current manner to exchange heat and moisture between them by continuously rotating the wheel 1 via a motor 5 associated with the wheel 1. After this exchanging process, the amount of energy required to heat, cool, humidify or dehumidify the supplied air is accordingly reduced, thereby achieving the purpose of saving energy.

The rotary-type total heat exchanger is effective in keeping indoor air quality, as well as in saving energy, as is identified above. However, in order to exhibit its full advantages, many improvements still can be made on the design of the rotary-type total heat exchanger. For example, the supplied air and the exhausted air to be exchanged are typically directed by blowers. The airflows from the blowers flow in a direction which are not to enable the airflows to flow evenly over the air passageways 2 of the rotary wheel 1. This greatly impairs the exchange rate of heat and moisture between the airflows. Moreover, the exchange of sensible heat between the airflows is conducted only by resorting to the heat-conductivity capacity of the heat exchange material used in the wheel 1, which limits the sensible heat exchange rate between the airflows.

In view of the above-mentioned disadvantages of the conventional rotary-type total heat exchanger, there is a need for a rotary-type total heat exchanger which can distribute airflows to be exchanged more evenly over air passageways of its rotary wheel. What is also needed is a rotary-type total heat exchanger which can improve the sensible heat exchange rate between the airflows conducting heat exchange in the rotary-type total heat exchanger.

SUMMARY

The present invention relates to a rotary-type total heat exchanger for conducting heat and moisture exchanges between different types of air. In one embodiment, the rotary-type total heat exchanger includes at least one blower, a rotary wheel, an air-guiding member and an air-regulating member. The at least one blower is used to provide a first airflow and a second airflow into the total heat exchanger. The rotary wheel defines therein a plurality of air passageways. Upon rotation, the rotary wheel is capable of exchanging heat and moisture between the airflows when the airflows separately flow though the air passageways of the rotary wheel. The air-guiding member is in fluid communication with the at least one blower for guiding one of the airflows toward the rotary wheel. The air-regulating member is located between the rotary wheel and the air-guiding member for distributing the guided airflow over the air passageways of the rotary wheel.

In another embodiment, a heat-pipe heat exchanger is provided in the total heat exchanger. The heat-pipe heat exchanger includes at least one heat pipe and a plurality of fins attached to the at least one heat pipe. The at least one heat pipe is maintained across the first airflow and the second airflow simultaneously.

Compared with the conventional art, the first airflow and the second airflow to be exchanged in the rotary-type heat exchanger are guided by the air-guiding member toward the rotary wheel and are further regulated by the air-regulating member to evenly distribute over the air passageways of the rotary wheel through which the exchange of heat and moisture between the airflows is conducted, thereby increasing the heat and moisture exchange rate between the airflows. Furthermore, the heat-pipe heat exchanger arranged in the total heat exchanger exchanges sensible heat (temperature) between the airflows via the at least one heat pipe and the fins, to thereby increase the sensible heat exchange rate between the airflows.

Other advantages and novel features of the present invention will become more apparent from the following detailed description of preferred embodiments when taken in conjunction with the accompanying drawings, in which:

DETAILED DESCRIPTION OF PREFERRED EMBODIMENTS

Figure 1:
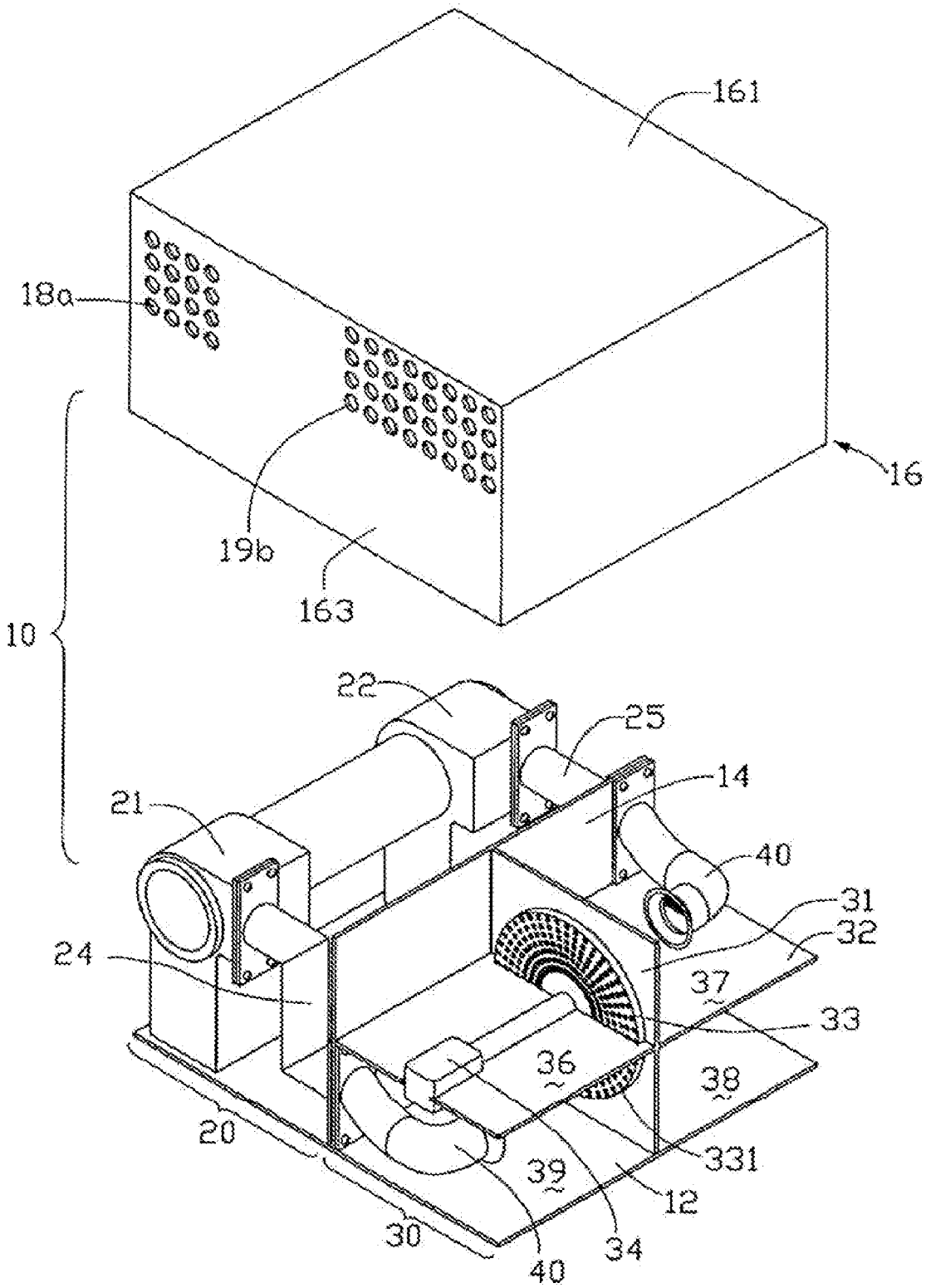
FIG. 1 is an exploded, isometric view of a rotary-type total heat exchanger in accordance with a first embodiment of the present invention.
Figure 2:
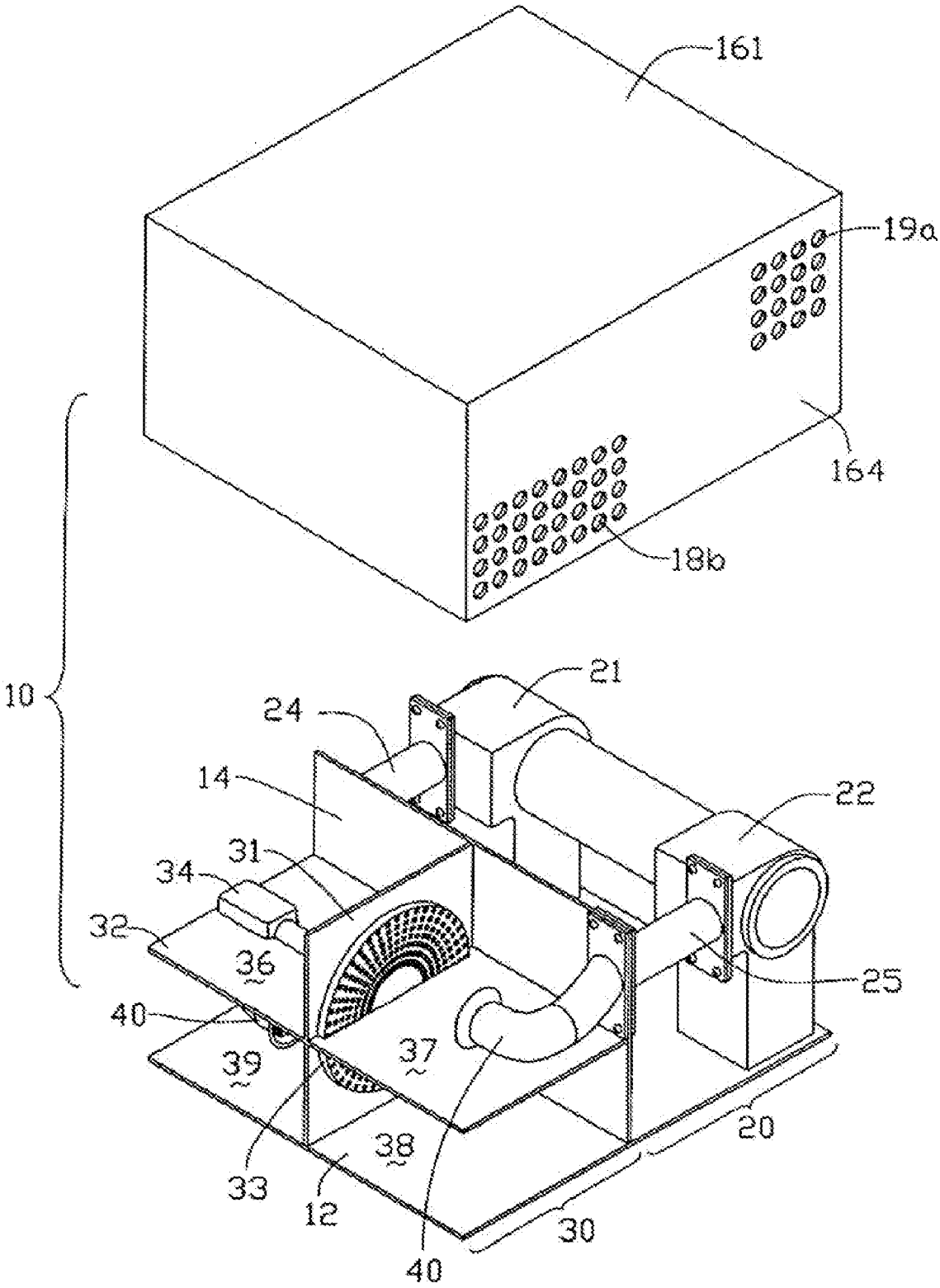
FIG. 2 is an exploded, isometric view of the rotary-type total heat exchanger of FIG. 1, but viewed from another aspect.

FIGS. 1 and 2 show a rotary-type total heat exchanger 10 in accordance with a first embodiment of the present invention. The total heat exchanger 10 may be suitably applied to a ventilation system, such as an air-conditioner, for supplying fresh outdoor air into indoors and exhausting dirty indoor air to outdoors. The total heat exchanger 10 includes a chassis 12, a partition plate 14 extending upwardly from the chassis 12 and a cover 16 for hermetically attaching to the chassis 12. After the cover 16 is connected to the chassis 12, the partition plate 14 partitions an interior of the total heat exchanger 10 into two adjacent first and second housings 20, 30. A plurality of inside components of the total heat exchanger 10 is respectively located in the first and second housings 20, 30.

Figure 12:
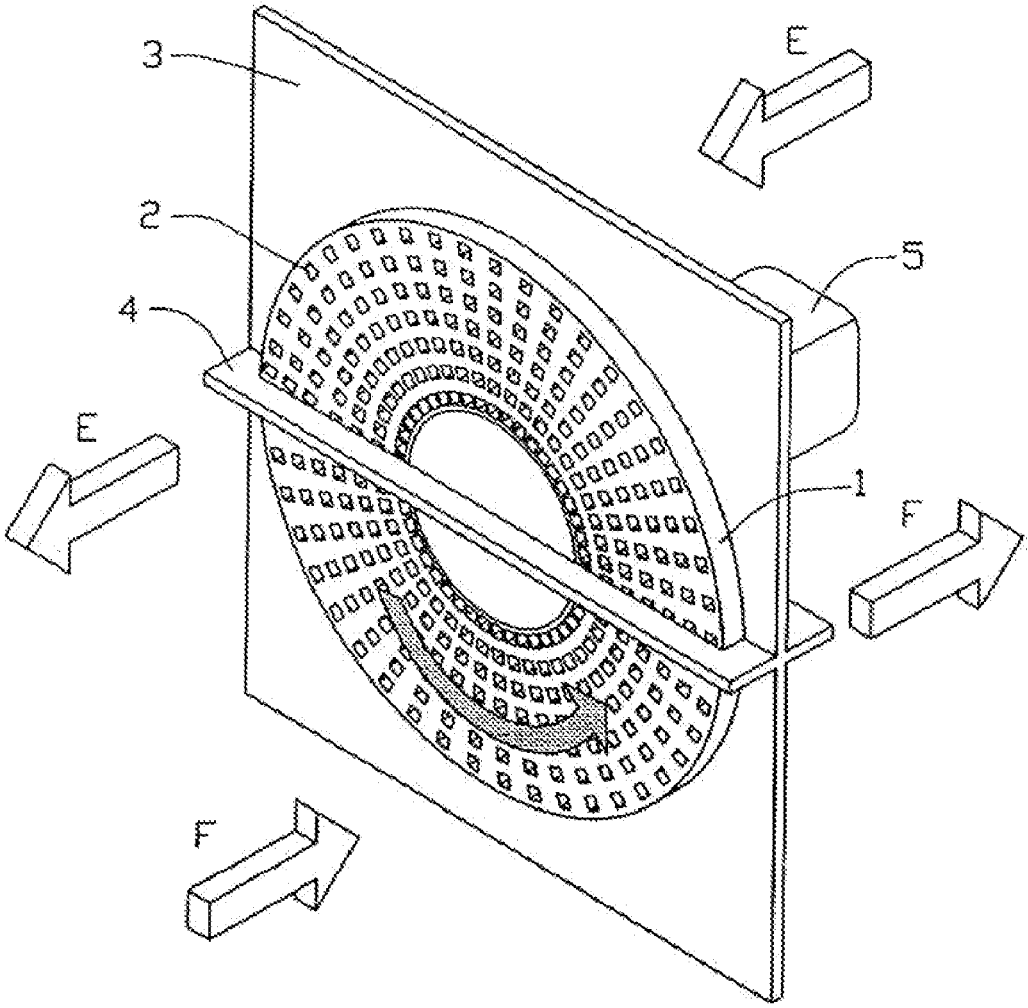
FIG. 12 (RELATED ART)
FIG. 12 is an isometric view of a rotary wheel for a rotary-type total heat exchanger in accordance with the conventional art.

The first housing 20 contains therein a pair of blowers 21, 22 located at opposite positions thereof, for providing two air streams, i.e., supplied outdoor air and exhausted indoor air. The second housing 30 contains therein a vertical plate 31 and a horizontal plate 32. The vertical plate 31 is disposed at a central position of the second housing 30 and is perpendicularly and hermetically connected to the chassis 12 and the partition plate 14. A rotary heat exchange wheel 33, which may be constructed in the same manner as shown in FIG. 12, is mounted to a central portion of the vertical plate 31. The rotary wheel 33 defines therein a plurality of air passageways 331. Upon rotation of the wheel 33 via a motor 34 connected thereto, the wheel 33 is capable of absorbing moisture and/or thermal energy from one stream and releasing the moisture and/or thermal energy to an adjacent stream. The horizontal plate 32 is perpendicularly and hermetically connected to the partition plate 14, and traverses the vertical plate 31 in such a manner that divides the wheel 33 into two semi-circular portions. After the cover 16 is combined to the chassis 12, the vertical plate 31 and horizontal plate 32 hermetically connected to an inner surface of the cover 16 to thereby divide the second housing 30 into four sub-housings 36, 37, 38, 39.

The cover 16 includes a rectangular top wall 161 and four sidewalls depending from the top wall 161, of which a pair of opposite sidewalls 163, 164 each defines therein two groups of holes 18*a*, 19*b* (18*b*, 19*a*) for acting as inlets or outlets of air from indoors or outdoors. For example, the first group of holes 18*a* defined in the sidewall 163 and located adjacent to the blower 21 may function as an inlet for dirty indoor air to enter into the total heat exchanger 10, and the second group of holes 19*b* defined in the sidewall 163 and located adjacent to the second sub-housing 36 may perform as an outlet for fresh outdoor air to enter into indoors after being heat-exchanged in the total heat exchanger 10. Similarly, the first group of holes 19*a* defined in the sidewall 164 and located adjacent to the blower 22 may function as an inlet for the outdoor air to enter into the total heat exchanger 10, and the second group of holes 18*b* defined in the sidewall 164 and opposing the holes 19*b* may act as an outlet for the indoor air to leave the total heat exchanger 10 after it is heat-exchanged therein. For easy understanding and description, the following context is based on the presumption that the blowers 21, 22 are respectively used to supply the dirty indoor air and the fresh outdoor air into the total heat exchanger 10.

In the first housing 20, a pair of air ducts 24, 25 is provided in order to guide and transfer the supplied air and the exhausted air from outlets of the blowers 21, 22 toward the second housing 30, wherein one air duct 24 is used to guide the exhausted dirty air to the sub-housing 39 and the other air duct 25 is applied to guide the supplied fresh air to the sub-housing 37 which is located diagonally to the sub-housing 39. In the second housing 30, a pair of air guiding-and-regulating members 40 is respectively provided in the sub-housings 37, 39 for succeedingly conveying and guiding the airflows from the pair of air ducts 24, 25 toward the two semi-circular portions of the wheel 33.

Figure 3:
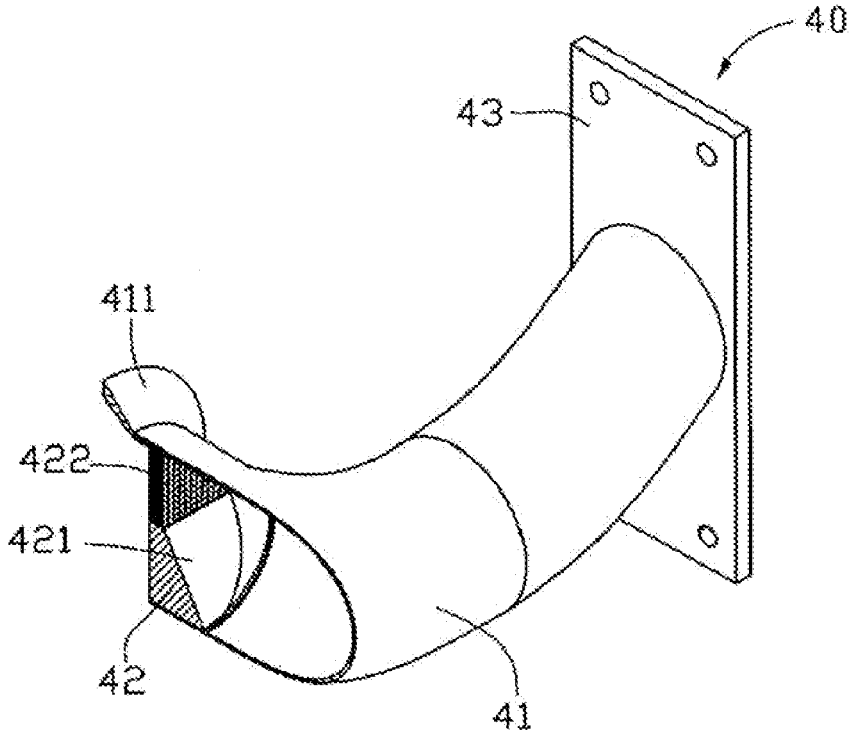
FIG. 3 is an isometric view of an air guiding-and-regulating member of the rotary-type total heat exchanger of FIG. 1.
Figure 4:
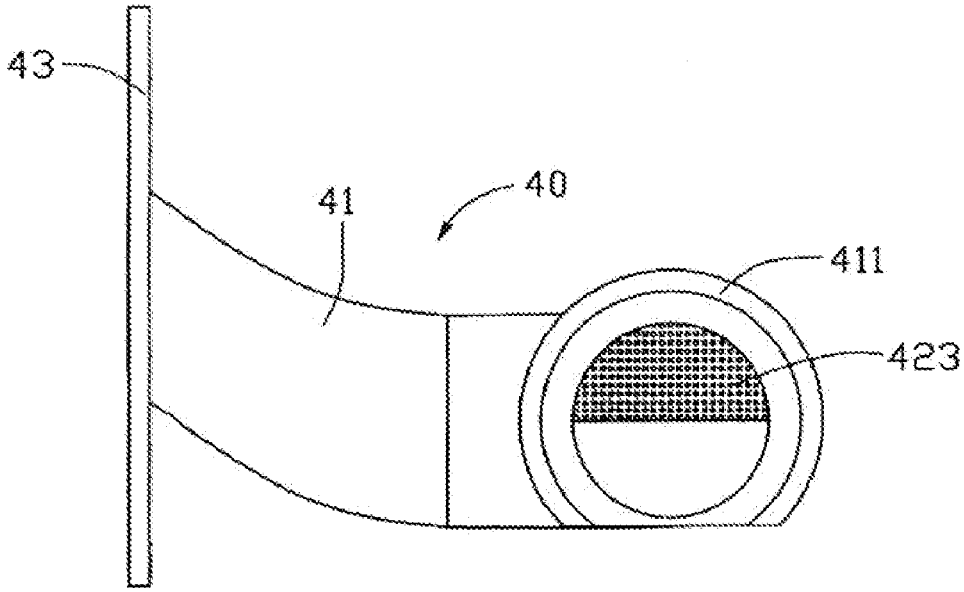
FIG. 4 is a side elevation view of the air guiding-and-regulating member of FIG. 3.
Figure 5:
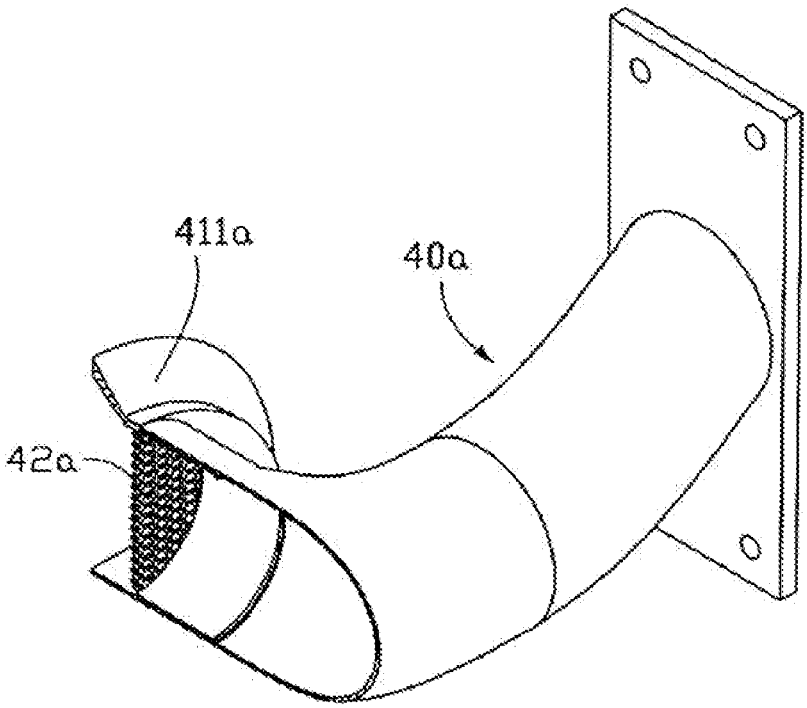
FIG. 5 is similar to FIG. 3, but showing an air guiding-and-regulating member according to another embodiment.
Figure 6:
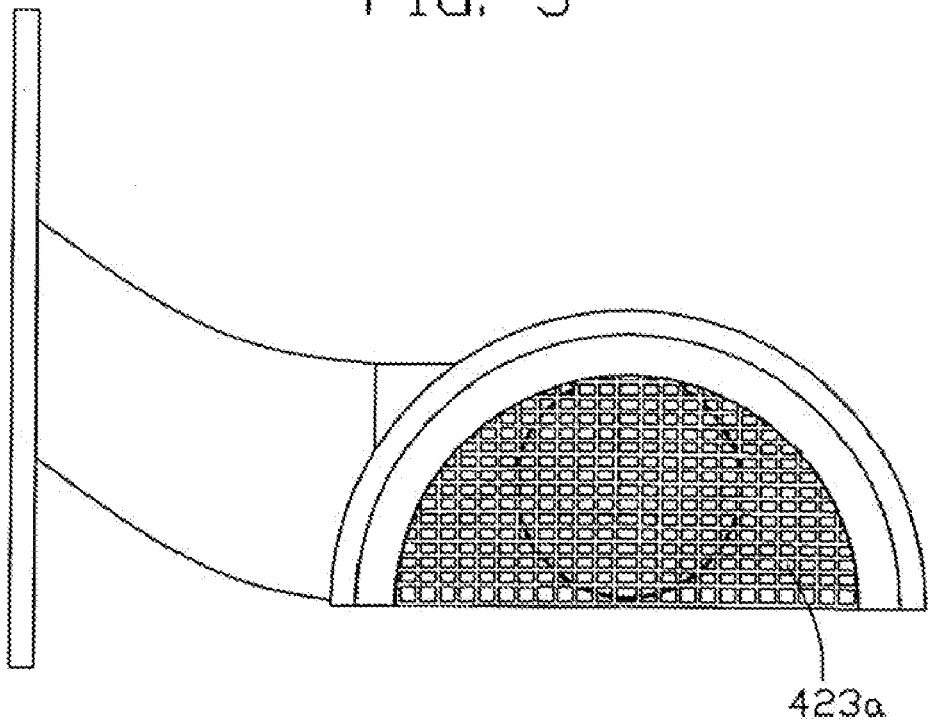
FIG. 6 is a side elevation view of the air guiding-and-regulating member of FIG. 5.

Referring to FIGS. 3-4, each of the air guiding-and-regulating members 40 includes a substantially L-shaped fan duct 41 and an air-regulating member 42 installed inside the fan duct 41 at an air-exiting end thereof. The air-exiting end of the fan duct 41 further extends outwardly to form an enlarged funnel-shaped guiding portion 411. The air-regulating member 42 includes a solid bottom portion 421 and a mesh-like or screen-like top portion 422. The top portion 422 defines therein a network of openings 423 for passage of air and therefore dividing the passing air into many smaller airflows. The bottom portion 421 has a thickness gradually reduced toward the top portion 422 to thereby form a slope for guiding the air guided by the fan duct 41 to move toward the top portion 422. A mounting plate 43 is attached to the other end of the fan duct 41 for facilitating the mounting of the fan duct 41 to the partition plate 14. FIGS. 5-6 show another air guiding-and-regulating member 40*a* which is generally similar to the air guiding-and-regulating members 40. However, the air guiding-and-regulating member 40*a* includes a semi-circular funnel-shaped guiding portion 411*a* and a semi-circular air-regulating member 42*a* which also defines therein a plurality of openings 423*a* for passage of air. Referring back to FIGS. 1-2, the mounting plate 43 is connected to the partition plate 14 to thereby establish communication with one of the air ducts 24, 25 located in the first housing 20, and the guiding portion 411 of the fan duct 41 is oriented at a position exactly facing a corresponding semi-circular portion of the wheel 33.

In operation, the dirty indoor air (exhausted air) and the fresh outdoor air (supplied air) are respectively directed by the blowers 21, 22 to pass through the air ducts 24, 25 and guided by the air guiding-and-regulating members 40 in the sub-housing 39, 37 to flow separately in a counter-current manner through the two semi-circular potions of the rotary wheel 33 where the heat and moisture exchanges between the airflows are conducted. As each of the airflows is guided to flow through the air-regulating member 42, the guided airflow is divided into many small airflows corresponding to the air passageways 331 of the wheel 33, to thereby distribute the guided airflow more evenly over the exchange surface of the wheel 331. After the exchanging process, the supplied air and the exhausted air are respectively guided into indoors and outdoors through the sidewalls 163, 164 of the cover 16. In accordance with the present invention, the airflows to be exchanged are evenly distributed over the air passageways 331 of the wheel 33 under the guidance and regulation of the air guiding-and-regulating members 40, thereby increasing the heat and moisture exchange rate between the airflows.

Figure 7:
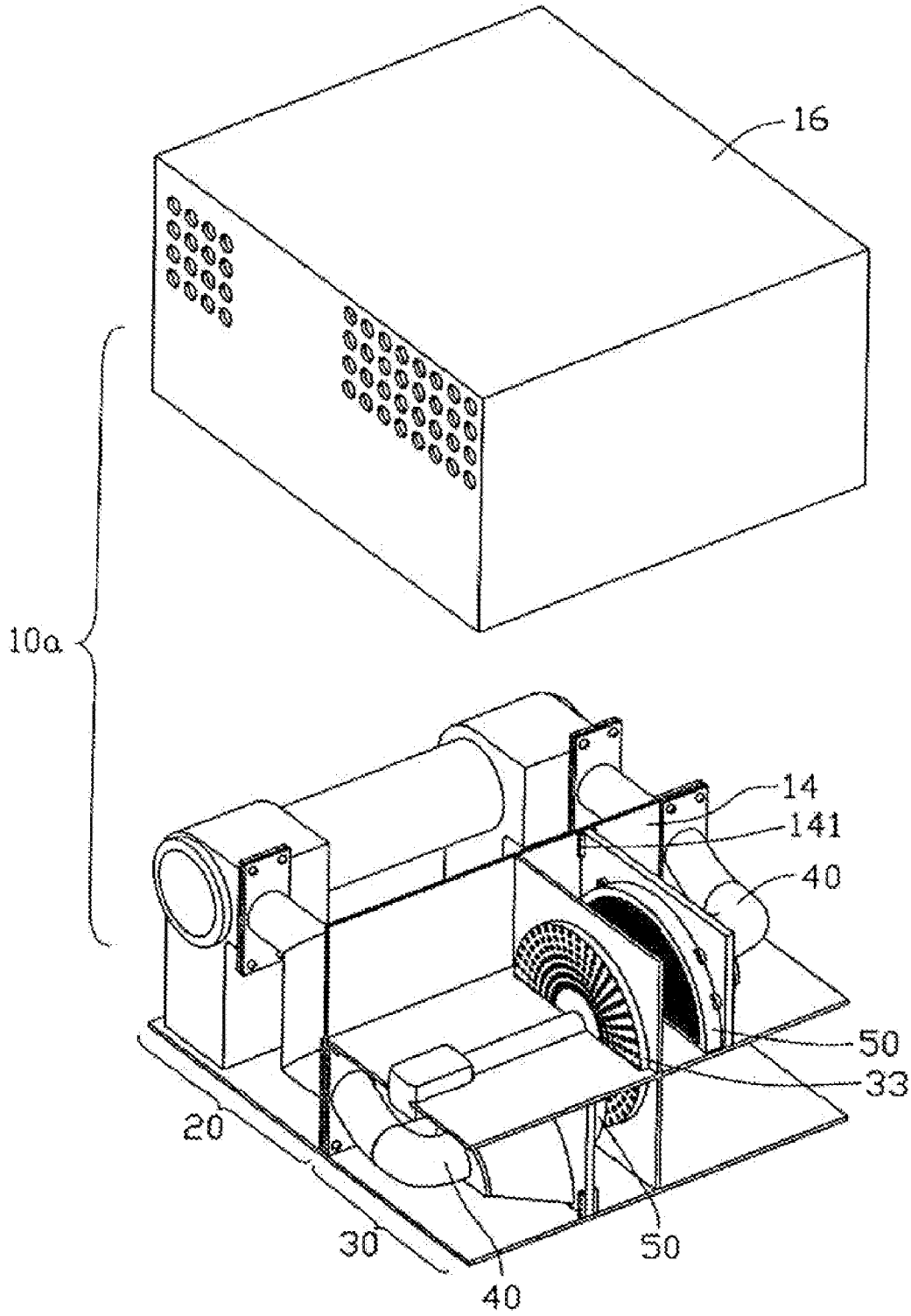
FIG. 7 is an exploded, isometric view of a rotary-type total heat exchanger in accordance with a second embodiment of the present invention.
Figure 8:
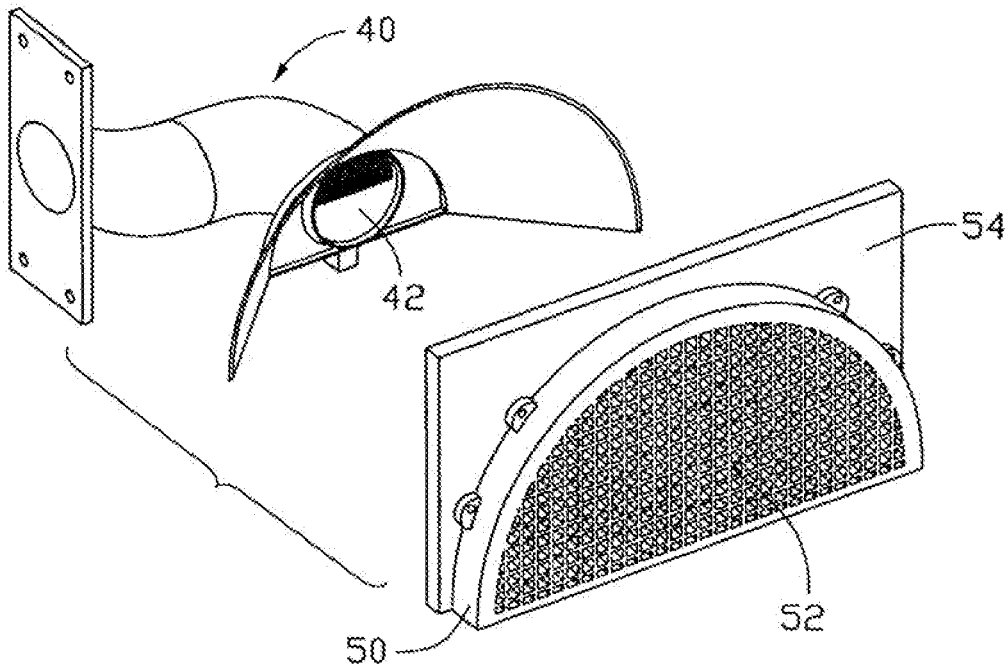
FIG. 8 is an isometric view of an air guiding-and-regulating member of the rotary-type total heat exchanger of FIG. 7.
Figure 9:
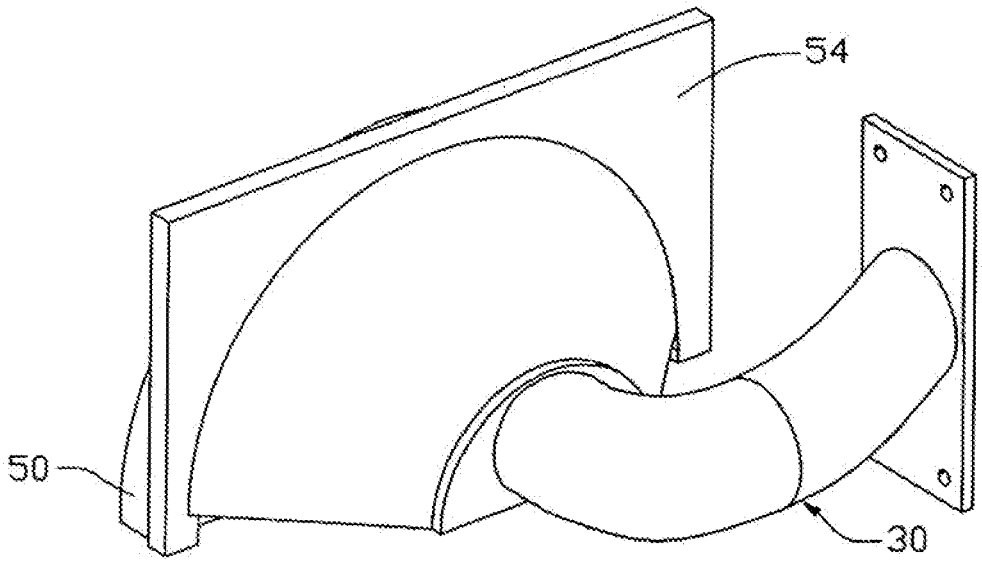
FIG. 9 is an isometric view of the air guiding-and-regulating member of FIG. 8, but viewed from another aspect.

FIG. 7 shows a total heat exchanger 10*a* in accordance with another preferred embodiment of the present invention. In this embodiment, a further second air-regulating member 50 is provided between the wheel 33 and the air guiding-and-regulating member 40 for allocating the air to be exchanged further more evenly over the air passageways 331 of the wheel 33. With reference to FIGS. 8-9, the second air-regulating member 50 has a larger size than the first air-regulating member 40 and is connected to the air guiding-and-regulating member 40. Preferably, the second air-regulating member 50 has such a size that is comparable to one semi-circular portion of the wheel 33. The second air-regulating member 50 defines therein a network of openings 52 and is fixed to a mounting frame 54. The second air-regulating member 50, together with the mounting frame 54, is removably secured to a pair of ribs 141 formed on the partition plate 14, as shown in FIG. 7. Thus, in this embodiment, each of the airflows to be exchanged is regulated by the first air-regulating member 40 and then the second air-regulating member 50 before arriving at the wheel 33.

Figure 10:
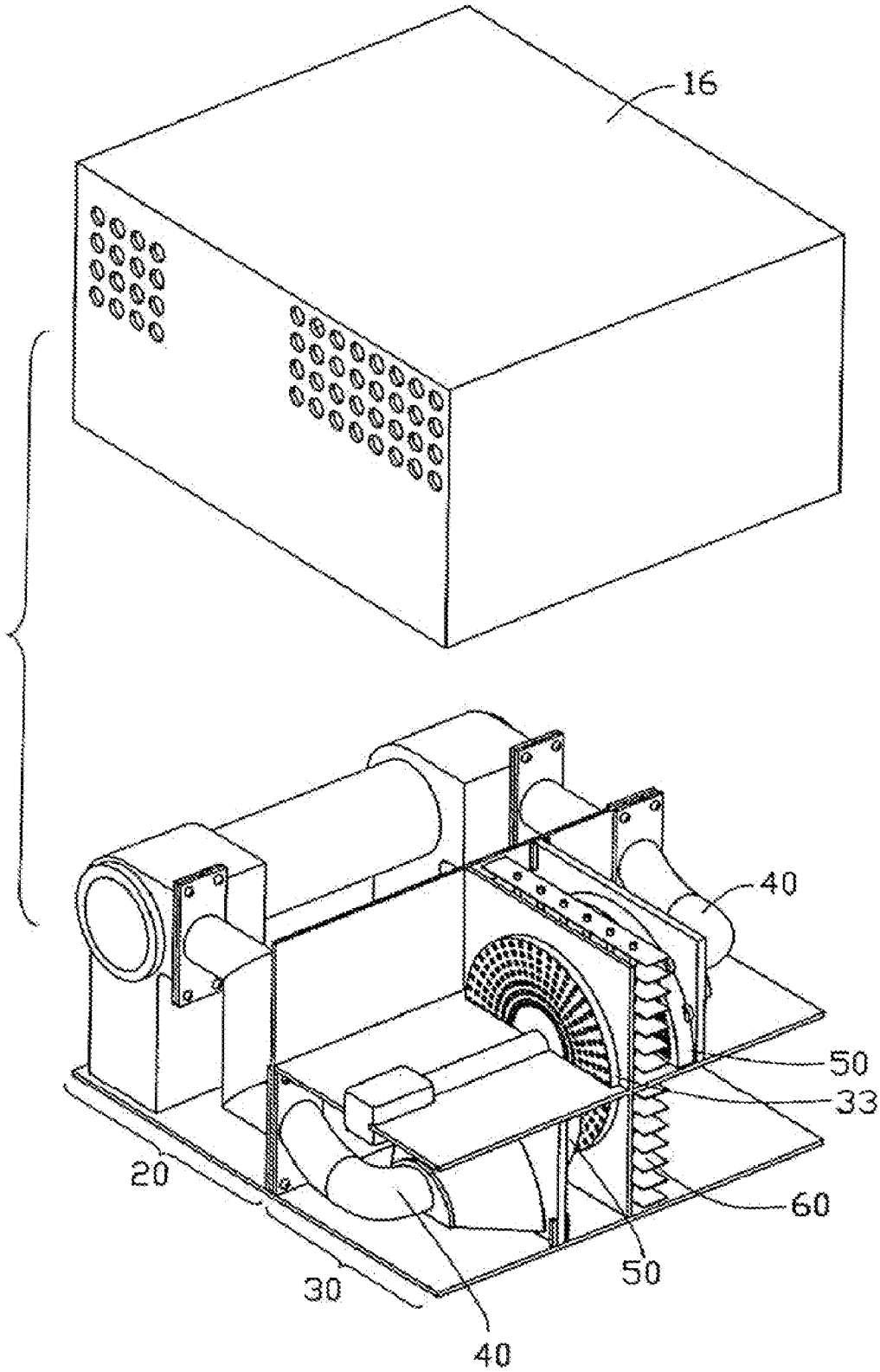
FIG. 10 is an exploded, isometric view of a rotary-type total heat exchanger in accordance with a third embodiment of the present invention.
Figure 11:
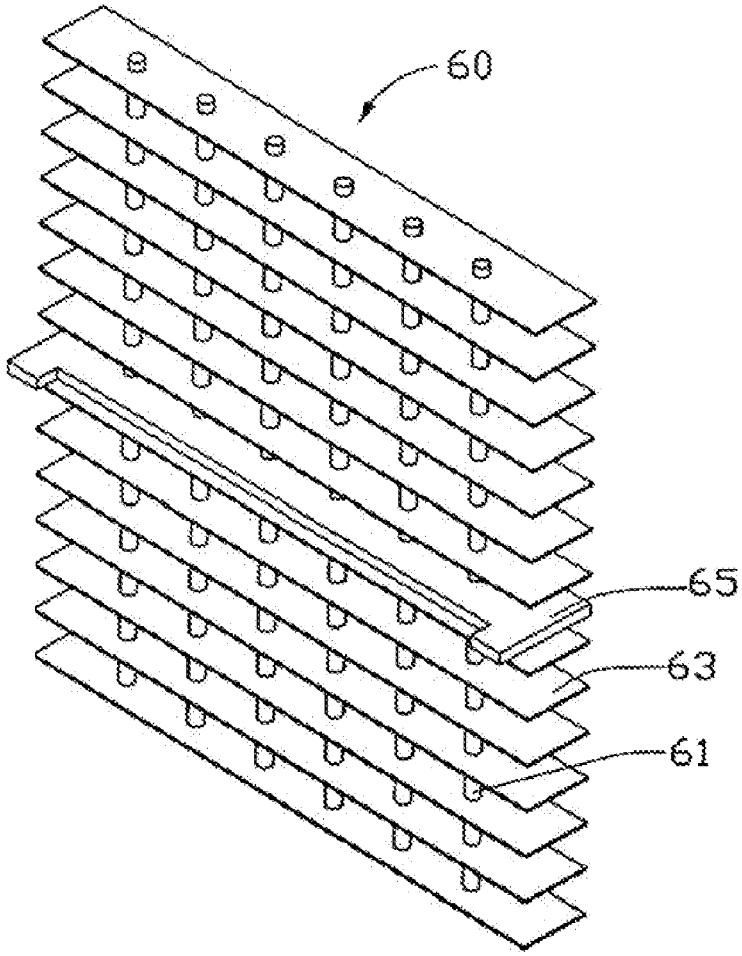
FIG. 11 is an isometric view of a heat-pipe heat exchanger of the rotary-type total heat exchanger of FIG. 10.

In order to increase the sensible heat exchange rate between the supplied air and the exhausted air, an additional heat exchange device may be provided in the total heat exchanger 10, 10*a*. For example, in the total heat exchanger 10*a*, a heat-pipe heat exchanger 60 is provided between the wheel 33 and the second air-regulating member 50, as shown in FIG. 10. The heat-pipe heat exchanger 60 spans across the two semi-circular portions of the wheel 33 and extends from the sub-housing 38 to the sub-housing 37. Referring also to FIG. 11, the heat-pipe heat exchanger 60 includes a plurality of heat pipes 61 and a plurality of spaced cooling fins 63 attached to the heat pipes 61. Each of the heat pipes 61 contains therein a working fluid for transferring heat by phase change. The heat pipes 61 and the cooling fins 63 are made from high thermally conductive materials such as copper or aluminum. A spacing member 65 is arranged at a central portion of the heat-pipe heat exchanger 60. The spacing member 65 divides the heat-pipe heat exchanger into two portions and is used to mount the heat-pipe heat exchanger 60 to the horizontal plate 32. As a hot air stream passes through one end of the heat pipe 61, the working fluid contained therein at that location absorbs heat and evaporates, then the generated vapor moves towards the other end of the heat pipe 61 where the vapor is condensed to liquid state by releasing the latent heat of evaporation to a cool air stream passing through the other end of the heat pipe 61, thereby increasing the sensible heat exchange between the two air streams. The condensed liquid then returns back to its original place and the cycle of evaporation and condensation of the working fluid goes on, thereby to continuously transfer heat from the hot air to the cool air. The cooling fins 63 attached to the heat pipe 61 can increase the total heat transfer area of the heat-pipe heat exchanger 60. Thus, in this embodiment, the sensible heat exchange between the supplied air and the exhausted air is conducted not only in the rotary wheel 33 but also in the heat-pipe heat exchanger 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotary-type total heat exchanger comprising:

a pair of blowers for providing a first airflow and a second airflow into the total heat exchanger, respectively;

a rotary wheel defining therein a plurality of air passageways, and upon rotation, the rotary wheel being capable of exchanging heat and moisture between the airflows when the airflows separately flow though the air passageways of the rotary wheel;

an air-guiding member in fluid communication with one blower for guiding one of the airflows toward the rotary wheel; and an air-regulating member located between the rotary wheel and the air-guiding member for distributing the guided airflow over the air passageways of the rotary wheel;

wherein the air-regulating member is connected to an air-exiting end of the air-guiding member, the air-regulating member includes a solid bottom portion and a mesh-like top portion, the top portion defines therein a network of openings for passage of the guided airflow and divides the guided airflow into many smaller airflows, and the bottom portion has a thickness gradually reduced toward the top portion to form a slope for guiding the guided airflow to move toward the top portion.

2. The rotary-type total heat exchanger of claim 1, wherein the first airflow is an indoor air to be exhausted to outdoors and the second airflow is an outdoor air to be supplied to indoors.

3. The rotary-type total heat exchanger of claim 1, further comprising a heat-pipe heat exchanger which includes at least one heat pipe spanning across the first airflow and the second airflow simultaneously.

4. The rotary-type total heat exchanger of claim 3, wherein the heat-pipe heat exchanger further comprises a plurality of cooling fins attached to the at least one heat pipe.

5. The rotary-type total heat exchanger of claim 1, wherein the blowers are located in a housing defined inside the total heat exchanger and the rotary wheel is located in an adjacent housing which is separated from the housing via a partition plate.

6. The rotary-type total heat exchanger of claim 5, wherein a dividing plate is provided in the adjacent housing to divide the rotary wheel into two semi-circular portions for the first airflow and the second airflow to pass through, respectively.

7. The rotary-type total heat exchanger of claim 6, wherein the air-guiding member is an L-shaped fan duct.

8. The rotary-type total heat exchanger of claim 6, wherein the air-exiting end of the air-guiding member is oriented towards one of the two semi-circular portions of the rotary wheel, and the top portion of the air-regulating member has a semi-circular shape similar to the one of the two semi-circular portions of the rotary wheel.

9. The rotary-type total heat exchanger of claim 8, further comprising another air-regulating member provided between the air-regulating member and the rotary wheel, the another air-regulating member having a larger size than the air-regulating member and defining therein a network of openings, and the network of openings of the another air-regulating member has a semi-circular shape comparable to the semi-circular portion of the rotary wheel.

10. A method for conducting heat and moisture exchanges between first airflow and second airflow, comprising the following steps:

providing a rotary wheel capable of absorbing moisture and thermal energy from the first airflow and upon rotation of the wheel, releasing the moisture and thermal energy to the second airflow, the rotary wheel defining therein a plurality of air passageways;

using an air-guiding member to guide one of the first airflow and the second airflow to face the rotary wheel; and using an air-regulating member to divide the guided airflow into many small airflows to distribute over and flow through the air passageways of the rotary wheel for conducting heat and moisture exchanges between the first airflow and the second airflow;

wherein the air-regulating member is connected to an air-exiting end of the air-guiding member, the air-regulating member includes a solid bottom portion and a mesh-like top portion, the top portion defines therein a network of openings for passage of the guided airflow and divides the guided airflow into many smaller airflows, and the bottom portion has a thickness gradually reduced toward the top portion to form a slope for guiding the airflow to move toward the top portion.

11. The method of claim 10, further comprising a step of providing between the air-regulating member and the rotary wheel another air-guiding member to further regulate the air distribution of the first airflow and the second airflow over the air passageways of the rotary wheel.

12. The method of claim 10, further comprising a step of providing at least one heat pipe spanning across the first airflow and the second airflow for increasing heat exchange therebetween.

13. A rotary-type total heat exchanger comprising:

an airflow generator generating a first airflow flowing from an indoors to an outdoors and a second airflow flowing from the outdoors to the indoors;

a rotary heat exchanger exchanging sensible heat and latent heat between the first and second airflows when the first and second airflows flow through the rotary heat exchanger in a counter-current manner, the rotary heat exchanger having a plurality of passageways therein;

a first guiding-and-regulating member dividing one of the first and second airflows into a plurality of smaller airflows before arriving at the rotary heat exchanger;

a second air-regulating member located between the rotary heat exchanger and the first guiding-and-regulating member;

a dividing plate being provided to divide the rotary heat exchanger into two semi-circular portions for the first airflow and the second airflow to pass through, respectively;

a partition plate being provided to separate the airflow generator from the rotary heat exchanger, the partition plate being perpendicular to the dividing plate; and a mounting frame being provided perpendicular to the dividing plate and the partition plate, the second air-regulating member being fixed to the mounting frame, a bottom of the second air-regulating member being positioned on the dividing plate.

14. The rotary-type total heat exchanger of claim 13 further comprising a sensible heat exchanger located between the second air-regulating member and the rotary heat exchanger, the sensible heat exchanger exchanging sensible heat between the first and second airflows.

15. The rotary-type total heat exchanger of claim 13, wherein the second air-regulating member having a size larger than that of the first guiding-and-regulating member and dividing the smaller airflows into even smaller airflows before arriving at the rotary heat exchanger.

16. The rotary-type total heat exchanger of claim 15, wherein the second air-regulating member defines therein a network of openings through which the smaller airflows are divided into the even smaller airflows.

17. The rotary-type total heat exchanger of claim 13, wherein the first guiding-and-regulating member has a mesh-like portion through which the one of the first and second airflows is divided into the smaller airflows.

18. The method of claim 11, wherein the another air-regulating member has a larger size than the air-regulating member and defines therein a network of openings, and the another air-regulating member has a semi-circular shape comparable to a semi-circular portion of the rotary wheel.

19. The rotary-type total heat exchanger of claim 16, wherein the second air-regulating member is semi-circular and the size of the second air-regulating member is comparable to a corresponding semi-circular portion of the rotary heat exchanger.

20. The rotary-type total heat exchanger of claim 13, wherein an air-exiting end of the first guiding-and-regulating member extends outwardly to form an enlarged funnel-shaped guiding portion, the guiding portion is attached to the mounting frame and covers the network of openings of the second guiding-and-regulating member so that the airflow from the air-exiting end of the first guiding-and-regulating member is guided to pass through the openings of the second guiding-and-regulating member.

* * * * *